US005753075A

United States Patent [19]

Stromberg et al.

[11] Patent Number: 5,753,075

[45] Date of Patent: May 19, 1998

[54] METHOD AND SYSTEM FOR FEEDING COMMINUTED FIBROUS MATERIAL

[76] Inventors: C. Bertil Stromberg, 4 Edison Rd., Glens Falls, N.Y. 12801; J. Wayne Chamblee, 65 Smoke Ridge Rd., #2; Bruno S. Marcoccia, 39 Elizabeth La., both of Queensbury, N.Y. 12804; Rolf C. Ryham, 5170 Overbend Trail, Suwanee, Ga. 30174; Erwin D. Funk, 17 Twicwood La., Queensbury, N.Y. 12804

[21] Appl. No.: 738,239

[22] Filed: Oct. 25, 1996

[51] Int. Cl.[6] ..... D21C 7/06

[52] U.S. Cl. ..... 162/52; 162/56; 162/237; 162/246

[58] Field of Search ..... 162/17, 18, 19, 162/52, 56, 57, 68, 237, 242, 243, 246

[56] References Cited

U.S. PATENT DOCUMENTS

| | | | |
|---|---|---|---|
| 2,635,548 | 4/1953 | Brawley | 103/103 |
| 2,908,226 | 10/1959 | Rich et al. | 103/128 |
| 3,303,088 | 2/1967 | Gessner . | |
| 3,322,616 | 5/1967 | Hutchinson et al. | 162/238 |
| 3,579,417 | 5/1971 | Carlsmith | 162/17 |
| 3,723,243 | 3/1973 | Vogel | 162/52 |
| 3,795,577 | 3/1974 | Pennington | 162/237 |
| 3,881,985 | 5/1975 | Simmons et al. | 162/17 |
| 4,968,385 | 11/1990 | Amador et al. | 162/18 |
| 5,164,042 | 11/1992 | Larsen et al. . | |
| 5,277,760 | 1/1994 | Fongen . | |
| 5,476,572 | 12/1995 | Prough . | |
| 5,500,083 | 3/1996 | Johanson . | |

OTHER PUBLICATIONS

*Some Engineering Considerations of a Wood–Chip Pipeline*, William A. Hunt, Forest Products Journal, Sep. 1963, pp. 365–367.

*'Chiplines'—Closer Than We Think*, Elliott, No. 363, Pulp & Paper, Aug. 10, 1964, pp. 27–29.

Perry et all, "Perry's Chemical Engineers' Handbook Sixth Edition", ©1984, pp. 6–16.

*Primary Examiner*—Donald E. Czaja
*Assistant Examiner*—Steven B. Leavitt
*Attorney, Agent, or Firm*—Nixon & Vanderhye P.C.

[57] ABSTRACT

A system and method for feeding comminuted cellulosic fibrous material such as wood chips to the top of a treatment vessel such as a continuous digester provide enhanced simplicity, operability, and maintainability by eliminating the high pressure transfer device conventionally used in the prior art. Instead of a high pressure transfer device the steamed and slurried chips are pressurized using one or more slurry pumps located at least thirty feet below the top of the treatment vessel and for pressurizing the slurry to a pressure of at least about 10 bar gauge. A return line from the top of the digester may, but need not necessarily, be operatively connected to the one or more pumps and if connected to the pumps the pressure in the return line may be reduced utilizing a pressure reduction valve and/or a flash tank. Steam from the flash tank may be used in steaming the chips. Pressure relief prevention may be provided by isolation valves in the lines leading to and from the top of the treatment vessel controlled by a controller which is responsive to the pressure sensed in the slurry line leading to the top of the treatment vessel.

20 Claims, 4 Drawing Sheets

METHOD AND SYSTEM FOR FEEDING COMMINUTED FIBROUS MATERIAL

BACKGROUND AND SUMMARY OF THE INVENTION

This invention relates to a method and system for feeding comminuted cellulosic fibrous material to a treatment vessel, such as a continuous digester. The invention simplifies and dramatically reduces the number of components needed when compared to the existing art.

U.S. Pat. Nos. 5,476,572, 5,622,598 and 5,635,025 and pending applications Ser. No. 08/713,431, filed on Sep. 13, 1996; introduced the first real breakthroughs in the art of feeding comminuted cellulosic fibrous material to a treatment vessel in over forty years. These patents and the application disclose several embodiments, collectively marketed under the trademark Lo-Level™ feed system by Ahlstrom Machinery Inc. of Glens Falls, N.Y. for feeding a digester using a slurry pump, among other components. As described in these patents and application, using such a pump to feed a slurry to a high-pressure transfer device dramatically reduces the complexity and physical size of the system needed, and increases the ease of operability and maintainability. The prior art systems employing a high-pressure transfer device, for example a High-Pressure Feeder as sold by Ahlstrom Machinery Inc., but without such a pump, are essentially unchanged from the systems sold and built since the 1940s and 1950s.

The present invention relates to an even more dramatic improvement to the methods and systems disclosed in the above-mentioned patent and applications. The present invention actually eliminates the need for transfer devices, such as a High-Pressure Feeder, by using high-pressure pumping devices to transfer a slurry of comminuted cellulosic fibrous material directly to a digester.

The reaction of pulping chemicals with comminuted cellulosic fibrous material to produce a chemical pulp requires temperatures ranging between 140°–180° C. Since the aqueous chemicals used to treat the material would boil at such temperatures, commercial chemical pulping is typically performed in a pressure-resistant vessel under pressures of at least about 10 bars gauge (approximately 150 psi gauge). In order to maintain this pressure, especially when performing a continuous pulping process, special accommodations must be made to ensure that the pressure is not lost when introducing material to the pressure vessel. In the prior art this was accommodated by what is known in the art as a "High-Pressure Feeder". This feeder is a specially-designed device containing a pocketed rotor which acts as a means for transferring a slurry of material from a low pressure to a high pressure while also acting as a valve for preventing loss of pressure. This complicated and expensive device has long been recognized as an essential component for introducing slurries of comminuted cellulosic material to pressurized vessels, typically at elevated temperatures, especially to continuous digesters.

According to the invention a system which replaces the High-Pressure Feeder—which has been recognized for over forty years as being essential to continuous digesting—is provided, greatly simplifying construction of a pulp mill.

According to one aspect of the present invention a system for producing chemical cellulose pulp from comminuted fibrous cellulose material, such as wood chips, comprises the following components: A steaming vessel in which comminuted fibrous cellulose material is steamed to remove the air therefrom. A superatmospheric pressure vertical treatment vessel having an inlet for a slurry of comminuted cellulose fibrous material at a top portion thereof and an outlet at a bottom portion thereof. And, pressurizing transfer means for pressurizing a slurry of material from the steaming vessel and transferring it to the treatment vessel inlet, the pressurizing transfer means consisting of one or more high pressure slurry pumps located below the top portion of the treatment vessel.

The one or more pumps preferably comprises first and second high pressure slurry pumps connected in series and each having a pressure rating, an inlet and an outlet, the first pump inlet operatively connected to the steaming vessel, the first pump outlet operatively connected to the second pump inlet, and the second pump having a higher pressure rating than the first pump. The slurry pumps may be helical screw centrifugal pumps, double-piston solids pumps, or other similar conventional pumping devices that are capable of pressurizing a slurry having a relatively high percentage of solids to (in one or more stages) a pressure of at least about 5 bar gauge. The pressurizing and transferring may also be effected by an one or more eductors, of conventional construction, driven by a pressurized fluid supply, such as supplied by conventional centrifugal pump.

One typical unit of measure that indicates the relative amount of solids in a slurry containing solids and liquid is the "liquid-to-solids ratio". In this application, this ratio is the ratio of the volume of liquid being transferred to the volume of cellulose, or wood, material being transferred. Typical conventional centrifugal liquid pumps are limited to pumping liquid having a solids content of at most 3%. This 4% solids content corresponds to a liquid-to-solids ratio of about 33. In the slurry pumps of this invention, the liquid-to-solids ratio of the slurry being pumped is typically between 2 and 10, preferably between 3 and 7, and most preferably between 3 and 6. In other words, the slurry pumps of this invention transfer slurries having a much greater solids content than can be handled by a conventional pump.

A liquid return line may be provided from the top portion of the treatment vessel, containing liquid separated from the slurry at the top of the treatment vessel (preferably a continuous digester). The return line may be operatively connected to an inlet or outlet of one of the slurry pumps, either directly or indirectly. Preferably the liquid return line is connected to a pressure reduction means for reducing the pressure of liquid in the return line before the liquid passes to the inlet or outlet of the slurry pump. The pressure reduction means may take a variety of forms, such as a flash tank and/or a pressure control valve in the return line, or other conventional structures for effectively reducing the pressure of liquid in a line while not adversely affecting the liquid. Where a flash tank is utilized the liquid outlet from the flash tank is connected to the inlet to the first slurry pump, and the steam produced by the flash tank may be used in the steaming vessel.

Alternatively, the pressure reduction may be effected, or even avoided, by using an eductor which uses the pressurized return line liquor as its source of pressurized fluid. An eductor may be used in place of or in conjunction with one or more of the slurry pumps, or other devices, to transfer slurry to the digester.

A conventional chute, as well as other optional components, is preferably connected between the steaming vessel and the at least one slurry pump, the steaming vessel being located above the chute and the chute above the at least one slurry pump. The at least one slurry pump is typically located a distance at least 30 feet (about 10 meters)

below the top of the digester, and typically more than about 50 feet (about 15 meters) below.

When the high pressure transfer device is eliminated it is desirable to utilize other mechanisms to retain one of the functions of the high pressure transfer device, namely providing pressure relief prevention should an aberrant condition occur, the high pressure transfer device typically preventing backflow of liquid from the digester into the feed system. Pressure relief preventing means according to the present invention are preferably distinct from the at least one slurry pump, although under some circumstances the inlets to or outlets from the slurry pumps may be constructed in a manner so as to provide pressure relief prevention. The pressure relief preventing means may comprise an automatic isolation valve in each of the slurry conduits transferring slurry from the pumps to the top of the treatment vessel and the return line from the treatment vessel, a conventional controller being provided connected to the isolation valves and operating the isolation valves in response to the pressure sensed by a pressure sensor associated with the slurry conduit feeding slurry to the top of the treatment vessel. The pressure relief preventing means may also comprise a check valve in the slurry conduit, and/or a variety of other valves, tanks, sensors, controllers, or like fluidic, mechanical, or electrical components which can perform the pressure relief preventing function.

The invention may also comprise means for augmenting the flow of liquid to the inlet to the second slurry pump, or to any pump or transfer device, such as a liquid line having liquid at a pressure below the pressure at the second slurry pump inlet, a conduit between the liquid line and the inlet, and a liquid pump in the conduit. The liquid line may be the return line from the treatment vessel, and the conduit may be connected directly to the return line. The liquid return line may be connected to a flash tank as described above, and the conduit may be connected to the flash tank liquid outlet.

According to another aspect of the present invention a method of feeding comminuted cellulosic fibrous material to the top of a treatment vessel is provided. The method comprises the steps of: (a) Steaming the material to remove air therefrom and to heat the material. (b) Slurrying the material with a cooking liquor to produce a slurry of liquid and material. And, (c) pressurizing the slurry to a pressure of at least about 5 bar gauge at a location below the top of the treatment vessel (e.g. at least thirty feet below, preferably at least fifty feet below), and transferring pressurized material to the top of the treatment vessel, the pressurizing step consisting of acting on the slurry with one or more high pressure slurry pumps.

The method may comprise the further steps of: (d) returning liquid separated from the slurry at the top of the treatment vessel to the at least one pump; and (e) sensing the pressure of the slurry while being transferred to the top of the treatment vessel, and shutting off the flow of slurry to the top of the treatment vessel and the return of liquid from the top of the vessel if the sensed pressure drops below a predetermined value. There also may be the step (f) of flashing the liquid while returning in the practice of step (d) to produce steam, and using the steam in the practice of step (a).

In an additional embodiment of this invention, the concept of transferring a slurry of chips is extended back to the point where chips are introduced to the mill, that is, the Woodyard. Conventional pulp mills receive their supply of cellulose material, typically hardwood and softwood but other forms of cellulose material as described above may be handled, in various forms. These include as sawdust, as chip, as logs, as long de-limbed trees (that is, "long wood"), or even as complete trees (that is, "whole trees"). Depending upon the source of cellulose of the "wood supply", the wood is typically reduced to chip form so that it can be handled and treated in a pulping process. For example, devices known as "chippers" reduce the long-wood or logs to chips that are typically stored in open chip piles or chip silos. This receipt, handling, and storage of the chips is performed in an area of the pulp mill referred to as the "Woodyard". From the Woodyard the chips are typically transferred to the pulp mill proper to initiate the pulping process.

In conventional Woodyards, the chips are stored in silos from which the chips are discharged, typically by means of a rotating or vibrating silo discharge device, to a conveyor. This conveyor is typically a belt-type conveyor which receives the chips and transfers them to the pulping treatment vessels. Since the Woodyard is typically at a distance from the pulping vessels, this conveyor is typically long. Such conveyors may have a length of up to one-half mile. In addition, treatment systems that do not employ the Lo-Level™ feeding system, as marketed by Ahlstrom Machinery and described in U.S. Pat. Nos. 5,476,572, 5,622,598 and 5,635,025 and pending Ser. No. application 08/713,431, require that the conveyor be elevated, typically to a height of at least 100 feet, in order to feed the chips to the inlet of the first pulping vessel. These conveyers, and the structures that support them, are very expensive and contribute a significant cost to the cost of a digester feed system.

In another embodiment of this invention, the concept of transferring a slurry of chips is extended back to the Woodyard. A preferred embodiment of this invention consists of a method of transferring comminuted cellulosic fibrous material to a pulping process, consisting of the following steps: (a) Introducing untreated chips to a first vessel. (b) Introducing slurrying liquid to the first vessel to create a slurry of material and liquid. (c) Discharging the slurry from the vessel to the inlet of at least one pressurizing and transferring device. (d) Pressurizing the slurry in the pressurizing and slurrying device and transferring the slurry to a treatment vessel.

The first vessel is typically a chip storage silo or bin. This bin preferably has a discharge having one-dimensional convergence without agitation or vibration, such as a DIAMONDBACK bin as described in U.S. Pat. No. 5,000,083, though agitation or vibration may be used. This bin may also have two or more outlets which feed two or more transfer devices. This vessel may also be operated at superatmospheric pressure, for example at 0.1 to 5 bar. If the vessel is operated at superatmospheric pressure some form of pressure isolation device must be located at the inlet of the vessel to prevent the release of pressure. This device may be a star-type isolation device, such as a Low-pressure Feeder or Air-lock Feeder as sold by Ahlstrom Machinery, or a screw-type feeder having a sealing capacity as described in co-pending application Ser. No. 08/713,431.

The slurrying liquid may be any source of liquid available in the pulp mill, including fresh water, steam condensate, kraft white, black, or green liquor or sulfite liquor or any other pulping-related liquid. This liquid may be a heated liquid, for example, hot water or steam, having a temperature of between 50° and 100° C. If the vessel is a pressurized vessel, liquid temperatures of over 100° C. may be used. Though not essential, this liquid may contain at least some active pulping chemical, for example, sodium hydroxide (NaOH), sodium sulfide (Na2S), polysulfide, anthraquinone or their equivalents or derivatives.

The pressurizing and transferring device of steps (c) and (d) is preferably a slurry pump, or pumps, but many other pressurizing and transferring devices may be used such as the piston-type solids pump or a high-pressure eductor. Preferably, more than one pressurizing and slurrying pump is used to transfer the slurry. These may be two or more slurry pumps, or any combination of slurry pump, piston-type pump, or eductor. This transfer system may also include one or more storage or surge tanks as well as transfer devices. Preferably, the one or more transfer devices include at least one device having de-gassing capability so that undesirable air or other gases may be removed from the slurry. Also, during transfer, the chips may be exposed to some form of treatment, for example, de-aeration or impregnation with a liquid, preferably a liquid containing pulping chemicals, such as those described above. The slurry may also be exposed to at least one pressure fluctuation during transfer, such that the pressure of the slurry is varied from a first pressure to a second, higher pressure, and then to a third pressure which is lower than the second pressure. As described in U.S. Pat. Nos.4,057,461 and 4,743,338 varying the pressure of a slurry of chips and liquor improves the impregnation of the chips by the liquor. This pressure pulsation may be achieved by varying the outlet pressure of a set of transfer devices in series, or by controlled depressurization of the slurry between pumping.

In another embodiment, the material need not encounter liquid in the vessel, but may have liquid first introduced to it by means of an eductor located in or below the outlet of the vessel. This liquid is preferably pressurized so that the material and liquid form a pressurized slurry of material and liquid.

The treatment vessel of step (d) may typically be a steaming vessel as described above, preferably a DIAMONDBACK steaming vessel. The vessel may also be a storage or surge tank in which the material may be stored prior to treatment. Since the transfer process may require excess liquor that is not needed during treatment or storage, some form of de-watering device may be located between the transfer device and the treatment vessel. One preferred dewatering device is a Top Separator, as sold by Ahlstrom Machinery. This Top Separator may be a standard type or an "inverted" Top Separator. This device may be an external stand-alone-type unit or one that is mounted directly onto the treatment vessel. Preferably, the liquid removed from the slurry by means of the de-watering device is returned to the first vessel or to the transfer devices to act as the slurring liquid. This liquid may also be used where ever needed in the pulp mill. This liquid may be heated or cooled as desired. For example, this liquid may heated by passing it in indirect heat exchange relationship with any heated liquid stream, for example, a waste liquid stream having a temperatures greater than 50° C. This liquid will also typically be pressurized using one or more conventional centrifugal liquid pumps.

In one preferred embodiment the treatment vessel of step (d) is a steaming vessel which feeds one or more transfer devices as described above. Though this system is preferably used in conjunction with a feed system not having a conventional High-pressure Feeder, this system may also be used with a feed system having a High-pressure Feeder.

This method and apparatus for feeding chips from a distant location, for example, a Woodyard, to a pulping process is not limited to chemical pulping processes, but may be used in any pulping process in which comminuted cellulosic fibrous material is conveyed from one location to another. The pulping processes that this invention is applicable to include all chemical pulping processes, all mechanical pulping processes, and all chemi-mechanical pulping or thermal mechanical pulping processes, for either batch or continuous treatment.

This invention not only reduces the size and cost of the system for transferring comminuted cellulosic fibrous material, but if the comminuted cellulosic fibrous material is treated during transfer, the number and size of the formal treatment vessels may be reduced. For example, this system may eliminate the need for conventional pretreatment or impregnation vessels prior to the digester. This system also has the potential for improving the over-all energy economy of the pulp mill. This and other aspects of the invention will become manifest upon review of the detailed description and figure below.

It is the primary object of the present invention to provide a simple and effective system and method for feeding cellulose slurry to a treatment vessel such as a continuous digester, and also while achieving enhanced operability and maintainability. This and other objects of the invention will become clear from an inspection of the detailed description of the invention and from the appended claims.

DETAILED DESCRIPTION OF THE DRAWINGS

Figure 1:
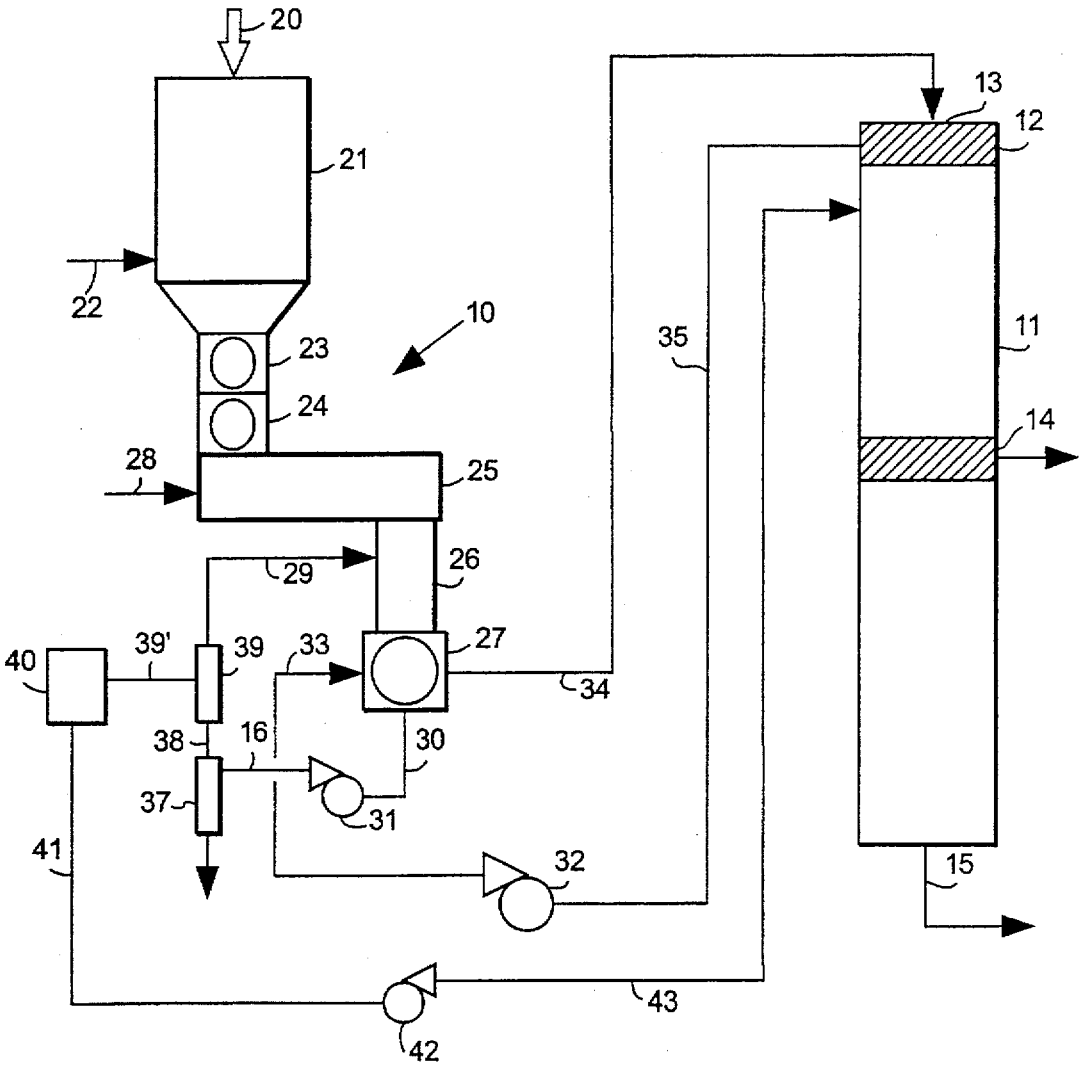
Fig. 1 (Prior Art)
FIG. 1 illustrates a typical prior art system for feeding a slurry of comminuted cellulosic fibrous material to a continuous digester.
Figure 2:
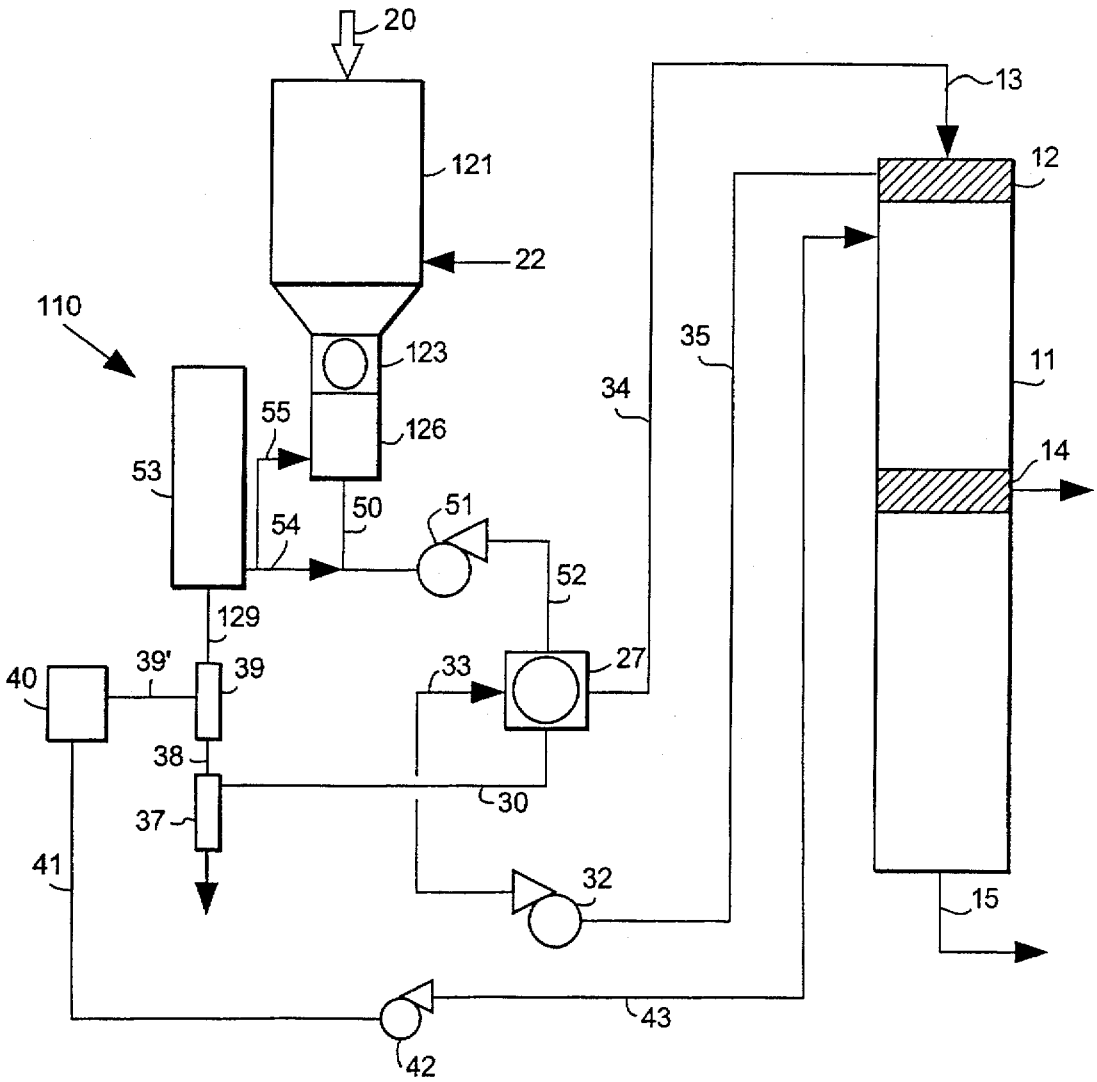
Fig. 2 (Prior Art)
FIG. 2 illustrates another prior at system for feeding a slurry of comminuted cellulosic fibrous material to a continuous digester.
Figure 3:
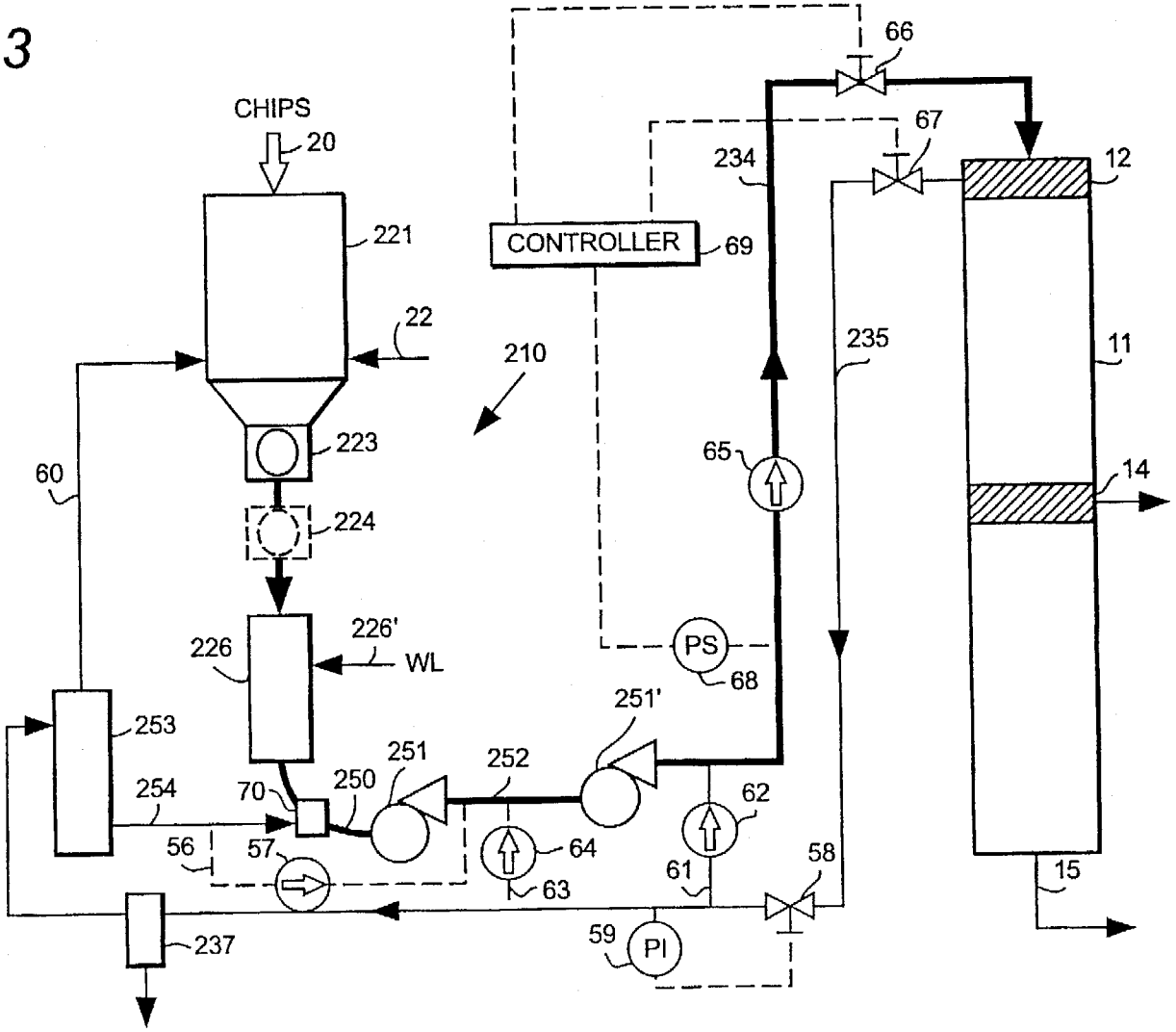
FIG. 3 illustrates one typical embodiment of a system for feeding a slurry of comminuted cellulosic fibrous material to a continuous digester according to this invention.

Though the systems shown and described in FIGS. 1–3 are continuous digester systems, it is understood that the method and system of the present invention can also be used to feed one or more batch digesters, or an impregnation vessel connected to a continuous digester. The continuous digesters shown and which may be used with this invention are preferably KAMYR® continuous digesters, and may be used for kraft (i.e., sulfate) pulping, sulfite pulping, soda pulping or equivalent processes. Specific cooking methods and equipment that may be utilized include the MCC®, EMCC®, and Lo-Solids® processes and digesters marketed by Ahlstrom Machinery Inc. Strength or yield retaining additives such as anthraquinone, polysulfide, or their equivalents or derivatives may also be used in the cooking methods utilizing the present invention.

FIG. 1 illustrates one typical prior art system 10 for feeding a slurry of comminuted cellulosic fibrous material, for example, softwood chips, to the top of a continuous digester 11. Digester 11 typically includes one liquor removal screen 12 at the inlet of the digester 13 for removing excess liquor form the slurry and returning it to feed system 10. Digester 11 also includes at least one liquor removal screen 14 for removing spent cooking liquor during or after the pulping process. Digester 11 also typically includes one or more additional liquor removal screens (not shown) which may be associated with cooking liquor circulation, such as an MCC®, EMCC® digester cooking circulation, or a Lo-Solids® digester circulation having a liquor removal conduit and a dilution liquor addition conduit. Cooking liquor, for example, kraft white, black, or green liquor, may be added to these circulations. Digester 11 also includes an outlet 15 for discharging the chemical pulp produced which may be passed on to further treatment such as washing or bleaching.

In the prior art feed system 10 shown in FIG. 1, comminuted cellulosic fibrous material 20 is introduced to chip bin 21. Typically, the material 20 is softwood or hardwood chips but any form of comminuted cellulosic fibrous material, such as sawdust, grasses, straw, bagasse, kenaf, or other forms of agricultural waste or a combination thereof, may be used. Though the term "chips" is used in the following discussion to refer to the comminuted cellulosic fibrous material, it is to be understood that the term is not limited to wood chips but refers to any form of the comminuted cellulosic fibrous materials listed above, or the like.

The chip bin 21 may be a conventional bin with vibratory discharge or a DIAMONDBACK® steaming vessel, as described in U.S. Pat. No. 5,500,083 and sold by Ahlstrom Machinery Inc., having no vibratory discharge but having an outlet exhibiting one-dimensional convergence and side relief. The bin 21 may include an airlock device at its inlet and a means for monitoring and controlling the level of chips in the bin and a vent with an appropriate mechanism for controlling the pressure within the bin. Steam, either fresh or steam produced from the evaporation of waste liquor (i.e., flashed steam), is typically added to bin 21 via one or more conduits 22.

The bin 21 typically discharges to a metering device, 23, for example a Chip Meter sold by Ahlstrom Machinery, but other forms of devices may be used, such as a screw-type metering device. The metering device 23 discharges to a pressure isolation device 24, such as a Low-Pressure Feeder sold by Ahlstrom Machinery. The pressure isolation device 24 isolates the pressurized horizontal treatment vessel 25 from the essentially atmospheric pressure that exists above device 24.

Vessel 25 is used to treat the material with pressurized steam, for example steam at approximately 10–20 psig. The vessel 25 may include a screw-type conveyor such as a Steaming Vessel sold by Ahlstrom Machinery. Clean or flashed steam is added to the vessel 25 via one or more conduits 28.

After treatment in vessel 25, the material is transferred to a high-pressure transfer device 27, such as a High-Pressure Feeder sold by Ahlstrom Machinery. Typically, the steamed material is transferred to the feeder 27 by means of a conduit or chute 26, such as a Chip Chute sold by Ahlstrom Machinery. Heated cooking liquor, for example, a combination of spent kraft black liquor and white liquor, is typically added to chute 26 via conduit 29 so that a slurry of material and liquor is produced in chute 26.

If the prior art system of FIG. 1 does employ a DIAMONDBACK® steaming vessel as disclosed in U.S. Pat. 5,000,083, which produces improved steaming under atmospheric conditions, the pressurized treatment vessel 25 and the pressure isolation device 24 may be omitted.

The conventional High-Pressure Feeder 27 contains a low pressure inlet connected to chute 26, a low pressure outlet connected to conduit 30, a high-pressure inlet connected to conduit 33, a high-pressure outlet connected to conduit 34, and a pocketed rotor driven by a variable-speed electric motor and speed reducer (not shown). The low pressure inlet accepts the heated slurry of chips from chute 26 into a pocket of the rotor. A screen in the outlet, at 30, of the feeder 27 retains the chips in the rotor but allows the liquor in the slurry to pass through the rotor to be removed via conduit 30 and pump 31. As the rotor turns the chips that are retained within the rotor are exposed to high pressure liquid from pump 32 via conduit 33. This high-pressure liquor slurries the chips out of the feeder and passes them to the top of digester 11 via conduit 34. Upon reaching the inlet of digester 11 some of the excess liquor used to slurry the chips in conduit 34 is removed from the slurry via screen 12. The excess liquor removed via screen 12 is returned to the inlet of pump 32 via conduit 35. The liquor in conduit 35, to which fresh cooking liquor may be added, is pressurized in pump 32 and passed in conduit 33 for use in slurrying the chips out of feeder 27. The chips that are retained by the screen 12 pass downwardly in the digester 11 for further treatment.

The liquor removed from feeder 27 via conduit 30 and pump 31 is recirculated to the chute 26 above the feeder 27 via conduit 36, sand separator 37, conduit 38, in-line drainer 39 and conduit 29. Sand separator 37 is a cyclone-type separator for removing sand and debris from the liquor. In-line drainer 39 is a static screening device which removes excess liquor from conduit 38 and passes it through conduit 39' and stores it in level tank 40. Liquor stored in tank 40 is returned to the top of the digester via conduit 41, pump 42 (i.e., the Make-up Liquor Pump), and conduit 43. Fresh cooking liquor may also be added to conduits 41 or 43.

FIG. 2 illustrates another prior art system 110 for feeding chips to a digester. This system uses processes and equipment described in U.S. Pat. Nos. 5,476,572, 5,622,598 and 5,635,025. This equipment and the processes they are used to effect are collectively marketed under the trademark Lo-Level™ by Ahlstrom Machinery. The components in FIG. 2 which are identical to those that appear in FIG. 1 are identified by the same reference numbers. Those components which are similar or which perform similar functions to those that appear in FIG. 1 have their reference numbers that appear in FIG. 1 prefaced by the numeral "1".

Similar to the system of FIG. 1, chips 20 are introduced to steaming vessel 121 where they are exposed to steam introduced via conduit 22. The vessel 121 discharges to metering device 123, and then to conduit 126, which is preferably a Chip Tube as sold by Ahlstrom Machinery. Cooking liquor is typically introduced to tube 126 via conduit 55, similar to conduit 29 of FIG. 1. Since the vessel 121 is preferably a DIAMONDBACK® steaming vessel as described in U.S. Pat. No. 5,000,083, no pressure isolation device, 24 in FIG. 1, or pressurized steaming vessel 25 in FIG. 1, are needed in this prior art system. As disclosed in U.S. Pat. No. 5,476,572 instead of discharging the slurry of chips and liquor directly to feeder 27, a high-pressure slurry pump 51 fed by conduit 50 is used to transport the chips to the feeder 27 via conduit 52. The pump 51 is preferably a Hidrostal pump as supplied by Wemco, or similar pump supplied by the Lawrence company. The chips that are passed via pump 51 are transported to digester 11 by feeder 27 in a manner similar to what was shown and described with respect to FIG. 1.

In addition to using the pump 51 to pass the slurry to the feeder 27, the system of FIG. 2 does not require the pump 31 of FIG. 1. Pump 51 supplies the motive force for passing liquor through the feeder 27, through conduit 30, sand separator 37, in-line drainer 39, and conduit 129 to liquor level tank 53.

The function of level tank 53 is disclosed in pending application Ser. No. 08/428,302, filed on Apr. 25, 1995. The tank 53 ensures a sufficient supply of liquor to the inlet of the pump 51, via conduit 54. This tank may also supply liquor to tube 126 via conduit 55. This liquor tank 53 also allows the operator to vary the liquor level in the feed system such that, if desired, the liquor level may be elevated to the metering device 123 or even to the bin 121. This option is also described in pending application Ser. No. 08/354,005, filed on Dec. 5, 1994.

FIG. 3 illustrates one preferred embodiment of a feed system 210 of the present invention that simplifies even further the prior art feeding systems shown in FIGS. 1 and 2. In the preferred embodiment shown in FIG. 3, the high-pressure transfer device, component 27 of FIGS. 1 and 2, has been eliminated. Instead of transferring chips to the feeder 27 by means of gravity in chute 26 of FIG. 1 or via pump 51 in FIG. 2, at least one, preferably two, high-pressure slurry pumps 251, 251' are used to transport the slurry to the inlet of the digester 11. The components in FIG. 3 which are essentially identical to those that appear in FIGS. 1 and 2 are identified by the same reference numbers. Those components which are similar or which perform similar functions to those that appear in FIGS. 1 and 2 have their reference numbers that appear in FIGS. 1 and 2 prefaced by the numeral "2".

Similar to the procedure in FIGS. 1 and 2, according to the present invention, chips 20 are introduced to steaming vessel 221. The chips are preferably introduced by means of a sealed horizontal conveyor as disclosed in pending application Ser. No. 08/713,431, filed on Sep. 13, 1996. Also, the steaming vessel 221 is preferably a DIAMONDBACK® steaming vessel as described in U.S. Pat. No. 5,000,083 to which steam is added via one or more conduits 22. The steaming vessel 221 typically includes conventional level monitoring and controls as well as a pressure-relief device (not shown). Vessel 221 discharges steamed chips to metering device 223, which, as described above, may be a pocketed rotor-type device such as a Chip Meter or a screw-type device.

In one embodiment of this invention the metering device 223 discharges directly to conduit or chute 226. However, in an optional embodiment, a pressure isolating device, such as a pocketed rotor-type isolation device, shown in dotted line at 224, for example a conventional Low-pressure Feeder, may be located between metering device 223 and chute 226. Though without the pressure-isolation device 224 the pressure in chute 226 is essentially atmospheric, with a pressure isolation device 224 the pressure in chute 226 may range from 1 to 50 psig, but is preferably between 5 to 25 psig, and most preferably between about 10 to 20 psig. Cooking liquor, as described above, is added to chute 226 (see line 226' in FIG. 3) so that a slurry of chips and liquor is produced in chute 226 having a detectable level (not shown). The slurry in chute 226 is discharged via radiused outlet 250 to the inlet of pump 251. The introduction of slurry to the inlet of pump 251 is typically augmented by liquor flow from liquor tank 253 via conduit 254 as described in U.S. Pat. No. 5,622,598.

Pump 251 is preferably a centrifugal high-pressure, helical screw, slurry pump, such as a "Hidrostal" pump supplied by Wemco of Salt Lake City, Utah. The pump 251 may alternatively be a slurry pump supplied by the Lawrence Company of Lawerence Mass. The pressure at the inlet to pump 251 may vary from atmospheric to 50 psig depending upon whether a pressure isolation device 224 is used.

In the preferred embodiment illustrated in FIG. 3, the outlet of pump 251 discharges to the inlet of pump 251'. Pump 251' is preferably the same type of pump as pump 251 but with the same or a higher pressure rating. If tow pumps are used, the pressure produced in the outlet of pump 251' typically ranges from 150 to 400 psig (i.e., 345–920 feet of water, gauge), but is preferably between about 200 and 300 psig (i.e., 460–690 feet). If necessary, the liquor in the slurry in conduit 252 may be augmented by liquor from tank 253 via conduit 56 and liquid pump 57.

Though the embodiment illustrated in FIG. 3 includes two pumps, only one pump, or even three or more pumps, in series or parallel, may alternatively be used. In these cases, the discharge presure from the one pump, or from the last pump, is preferably the same as the discharge pressure from pump 251' above.

The pressurized, typically heated, slurry is discharged from pump 251' to conduit 234. Conduit 234 passes the slurry to the inlet of continuous digester 11. Excess liquor in the slurry is removed via screen 12 as is conventional. The excess liquor is returned to the feed system 210 via conduit 235, preferably to liquor tank 253 for use in slurrying in conduit 250 via conduit 254. The liquor in conduit 235 may be passed through a sand separator 237 if desired. This sand separator 237 may be designed for pressurized or unpressurized operation depending upon the mode of operation desired.

Unlike the prior art systems employing a High-Pressure Feeder (27 in FIGS. 1 and 2) which uses the pressure of the liquor returned via conduit 35 as an integral part of the method of slurrying from the High-Pressure Feeder to the digester 11, it is not essential for the operation of the present invention that the pressurized recirculation 235 be returned to the inlet of the pumps 251, 251'. The energy available in the pressure of the flow in line 235 may be used wherever necessary in the pulp mill. However, in a preferred embodiment, the present invention does utilize the pressure available in conduit 235 to minimize the energy requirements of pumps 251 and 251' as much as possible.

How the pressure in return line 235, typically about 150 to 400 psig is used depends upon the mode of operation of the feed system 210. If vessel 226 is operated in an unpressurized—essentially atmospheric—mode, the pressurized liquor returned in conduit 235 must be returned to essentially atmospheric pressure before being introduced to conduit 250. One means of doing this is to use a pressure control valve 58 and a pressure indicator 59 in conduit 235. The opening in valve 58 is controlled such that a predetermined reduced pressure exists in line 235 downstream of valve 58. In addition, the liquor tank 253 may be designed so that it acts as a "flash tank" so that the hot pressurized liquor in conduit 235 is rapidly evaporated to produce a source of steam in vessel 253. This steam can be used, among other places, in vessel 221 via conduit 60. However, instead, in a preferred embodiment, the pressurized liquor in conduit 235 is used to augment the flow out of pump 251', for example via conduit 61 and pump 62. The pressure in conduit 235 may also be used to augment the flow between pumps 251 and 251' in conduit 252 via conduit 63, with or without pump 64 (a check valve may in some cases be used in place of or in addition to each of pumps 62, 64). By reusing some of the pressure available in line 235, some of the energy requirements of pumps 251 and 251' may be reduced.

Also, the heat of the liquor in line 235 can also be passed in heat-exchange-relationship with one or more other liquids in the pulp mill that need to be heated.

The pressurizing and transferring of pumps 251 and 251' may instead by effected by a conventional eductor, for example, an eductor manufactured by Fox Valve Development Corporation. Or pumps 251, 251' may be used in conjunction with an eductor for increasing the pressure in the inlet or outlet of the pumps. An eductor may also be used as a means of introducing liquid to the chips. For example, an eductor may be located in the outlet of or beneath vessel 226 and liquid first introduced to the chips by means of this eductor. The eductor may comprise a venturi-type orifice in one or more conduits 250, 252, and 234 into which a pressurized stream of liquid is introduced. This pressurized liquid may be obtained from any available source but is preferably obtained from conduit 235, upstream of valve 58. An exemplary eductor is shown schematically at 70 in FIG. 3.

The pumps 251 and 251' need not be centrifugal pumps but may be any other form of slurry transfer device that can directly act on to pressurize and transfer a slurry of chips and liquor from the outlet of vessel 226 to the inlet of digester 11. For instance, a solids pump as typically used in the mining industry may be used; for example, a double-piston solids pump such as the KOS solids pump sold by Putzmeister, or any other similar conventional pumping device may be used.

One function of the prior High-Pressure Feeder 27 of FIGS. 1 and 2 is to act as a shut-off valve to prevent possible escape of the pressure in the equipment and transfer conduits, for example, conduits 34 and 35 of FIG. 1, should any of the feed components malfunction or fail. In the feed system 210 according to the present invention, alternative means are provided to prevent such release of pressure due to malfunction or failure. For example, FIG. 3 illustrates a one-way (check) valve 65 in conduit 234 to prevent pressurized flow from returning to pump 251 or 251'. In addition, conventional automatic (e.g. solenoid operated) isolation valves 66 and 67 are located in conduits 234 and 235, respectively, to isolate the pressurized conduits 234, 235 from the rest of the feed system 210. In one preferred mode of operation, a conventional pressure switch 68 is located downstream of pump 251' in conduit 234. The switch 68 is used to monitor the pressure in line 234 so that should the pressure deviate from a predetermined value, the conventional controller 69 will automatically isolate digester 11 from feed system 210 by automatically closing valves 66 and 67. These valves may also be automatically closed when a flow direction sensor detects a reversal of flow in conduit 234.

While the pressure release preventing means 65–69 described above is preferred, other arrangements of valves, sensors, indicators, alarms, or the like may comprise the pressure release preventing means as long as such arrangements adequately perform the function of preventing significant depressurization of the digester 11.

While the system 210 is preferably used with a continuous digester 11, it also may be used with other vertical superatmospheric (typically a pressure of at least about 10 bar gauge) treatment vessels having a top inlet, such as an impregnation vessel or a batch digester.

Figure 4:
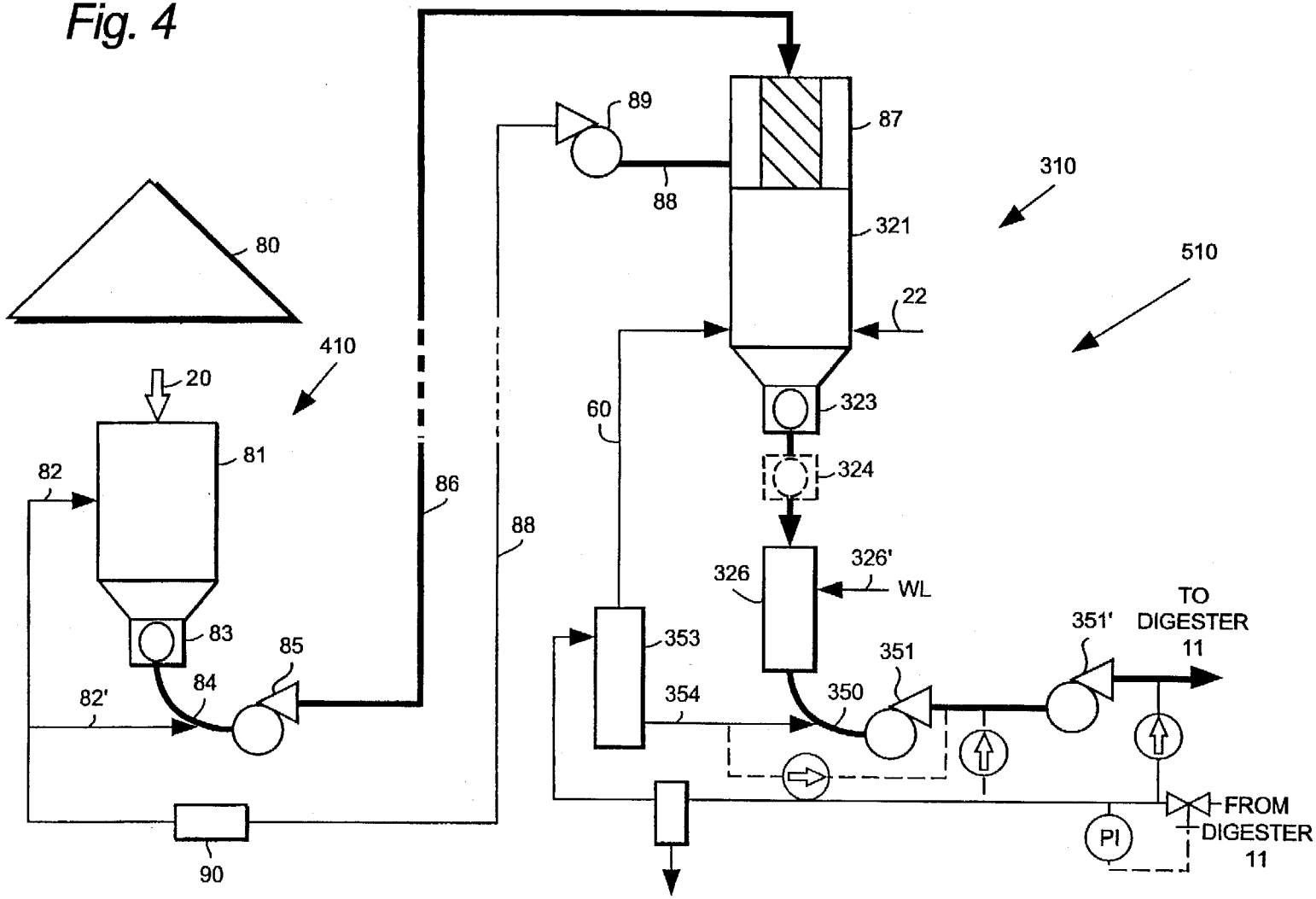
FIG. 4 illustrates another embodiment of the invention.

FIG. 4 illustrates a further embodiment of this invention in which the concept of transferring chips is extended from the feed system of digester to the Woodyard of a pulp mill. FIG. 4 illustrates a system 510 for feeding comminuted cellulosic fibrous material to a pulping process. It consists of a subsystem 410 for introducing chips from the Woodyard to system 510 and a subsystem 310 for treating and feeding chips to digester 11. Subsystem 310 is essentially identical to the system 210 shown in FIG. 3.

Again, the components in FIG. 4 which are identical to those that appear in FIGS. 1–3 are identified by the same reference numbers. Those components which are similar or which perform similar functions to those that appear in FIG. 1–3 have their reference numbers that appear in FIG. 1 prefaced by the numeral "3".

The Woodyards of conventional pulp mills receive their wood supply in various forms as described above. Typically, the wood, or other comminuted cellulosic fibrous material, is converted to chip like form and stored either in open chip piles or in chip storage silos. In FIG. 4 the chip supply is shown as chip pile 80. In a preferred embodiment of this invention the chips from pile 80 or some other storage vessel are conveyed by conventional means, e.g., a conveyor or front-end loader (not shown), and introduced 20 to vessel 81. This vessel may be a DIAMONDBACK vessel or any other conventional storage vessel. Vessel 81 may be operated at superatmospheric pressure, for example at 0.1 to 5 bar. If the vessel is operated at superatmospheric pressure, some form of pressure isolation device (not shown) may be located at the inlet of the vessel to prevent the release of pressure. This device may be a star-type isolation device, such as a Low-pressure Feeder or Air-lock Feeder as sold by Ahlstrom Machinery, or a screw-type feeder having a sealing capacity as described in co-pending application Ser. No. 08/713,431.

Liquid, for example fresh water, steam, liquids containing cooking chemicals is introduced to vessel 81 via one or more conduits 82 to produce a slurry of liquid and chips and to provide a detectable liquid level in vessel 81. Means for monitoring and controlling the level of the liquid, and the level of the chips, in vessel 81 may be provided. This liquid may be a heated liquid, for example, hot water or steam, having a temperature of between 50° and 100° C. If the vessel is a pressurized vessel, liquid temperatures of over 100° C. may be used. Preferably, though not essentially, this liquid may contain at least some active pulping chemical, for example, sodium hydroxide (NaOH), sodium sulfide (Na2S), polysulfide, anthraquinone or their equivalents or derivatives.

From vessel 81, the slurry is discharged to the inlet of slurry pump 85 via conduit 84. The discharge from vessel 81 may be aided by a discharge device 82. The flow of slurry in conduit 84 may also be aided by the addition of liquid via conduit 82'. Pump 85 may be any type of slurry pump discussed above, for example, a Wemco or Lawrence pump or their equivalents, any other type of solids or slurry transfer device. Though only one pump 85 is shown, more than one pump or similar devices may be used to transfer the slurry via conduit 86 to vessel 321. The slurry transfer via conduit 86 may include one or more storage or surge tanks (not shown). Preferably, the one or more pumps 85 include at least one device having de-gassing capability so that undesirable air or other gases may be removed from the slurry. The pressure in conduit 86 is dependent upon the number of pumps and other transfer devices used and the height and distance that the slurry must be transferred. The pressure in conduit 86 may vary from about 5 psig to over 500 psig.

Also, during transfer, the chips may be exposed to some form of treatment, for example, de-aeration or impregnation with a liquid, preferably a liquid containing pulping chemicals, such as those described above. The slurry may also be exposed to at least one pressure fluctuation during transfer, such that the pressure of the slurry is varied from a first pressure to a second, higher pressure, and then to a third pressure which is lower than the second pressure. As described in U.S. Pat. Nos. 4,057,461 and 4,743,338 varying the pressure of a slurry of chips and liquor improves the impregnation of the chips with the liquor. This pressure pulsation may be achieved via varying the outlet pressure of a set of transfer devices in series, or by controlled depressurization of the slurry between pumping.

The slurry in conduit 86 is introduced to the inlet of vessel 321. Though the vessel shown is a treatment, i.e., steaming, vessel, it may also be a storage vessel, an impregnation vessel, or even a digester. Since the transfer in conduit 86 typically requires that at least some excess liquid, that is not needed during treatment or storage, some form of de-watering device 87 may be located between the transfer device and the treatment vessel. One preferred dewatering device is a Top Separator, as sold by Ahlstrom Machinery. This Top Separator may be a standard type or an "inverted" Top Separator. This device may be an external stand-alone-type unit or one that is mounted directly onto the treatment vessel, as shown. Preferably, the liquid removed from the slurry by means of de-watering device 87 is returned to vessel 82 or to the inlet of the pump, or pumps, 85 via conduit 88 to aid in slurrying the chips. This liquid removed via device 87 may also be used where ever needed in the pulp mill. This liquid in conduit 88 may be heated or cooled as desired in a heat exchanger 90 and may be pressurized using one or more conventional centrifugal liquid pumps, 89. The liquid in conduit 88 may be introduced to vessel 81 via conduit 82 and to conduit 84 via conduit 82'.

The treatment vessel 321 shown is a steaming vessel similar to vessel 221 shown in FIG. 3, for example a DIAMONDBACK steaming vessel. The feed system 310 is otherwise similar to the system 210 shown in FIG. 3. For example, chip feeding system 410, feeds digester feed system 310, which feeds digester 11. Note that system 310 of FIG. 4 is simply one subsystem in the over-all system which feeds chips from the chip pile 80 to the digester 11. This system may include one or more subsystems 310 for feeding to digester 11.

In the broadest aspect of this invention, a system and method are provided for the multistage transport and treatment of comminuted cellulosic fibrous material with the economical recovery and re-use of energy, including thermal energy.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for producing chemical cellulose pulp from comminuted fibrous cellulose material, comprising:

a steaming vessel in which comminuted fibrous cellulose material is steamed to remove the air therefrom;

a superatmospheric pressure vertical treatment vessel having an inlet for a slurry of comminuted cellulose fibrous material at a top portion thereof and an outlet at a bottom portion thereof; and pressurizing transfer means for pressurizing a slurry of material from the steaming vessel and transferring it to said treatment vessel inlet, said pressurizing transfer means consisting of one or more high pressure slurry pumps located below said top portion of said treatment vessel.

2. A system as recited in claim 1 wherein said one or more pumps comprises first and second high pressure slurry pumps connected in series and each having a pressure rating, an inlet and an outlet, said first pump inlet operatively connected to said steaming vessel, and said first pump outlet operatively connected to said second pump inlet.

3. A system as recited in claim 2 wherein said pumps are centrifugal pumps capable of pumping a slurry have a liquid-to-solid ratio of between 2 and 10.

4. A system as recited in claim 2 further comprising a liquid return line from said top portion of said treatment vessel, said return line operatively connected to an inlet or outlet of one of said slurry pumps.

5. A system as recited in claim 4 wherein said liquid return line is connected to a pressure reduction means for reducing the pressure of liquid in said return line before the liquid passes to said inlet or outlet of a slurry pump.

6. A system as recited in claim 5 wherein said pressure reduction means comprises a flash tank, and wherein liquid from said flash tank is directed to said inlet to said first slurry pump.

7. A system as recited in claim 5 wherein said pressure reduction means comprises a pressure control valve in said return line.

8. A system as recited in claim 1 further comprising an eductor operatively connected to an inlet or outlet of a high pressure slurry pump.

9. A system as recited in claim 1 further comprising a chute connected between said steaming vessel and said at least one slurry pump, said steaming vessel above said chute and said chute above said at least one slurry pump, and said at least one slurry pump at least thirty feet below said treatment vessel inlet.

10. A system as recited in claim 1 further comprising pressure relief preventing means distinct from said at least one slurry pump.

11. A system as recited in claim 10 further comprising a liquid return line from said top portion of said treatment vessel operatively connected to said at least one slurry pump; and a slurry conduit extending between said at least one slurry pump and said top portion of said treatment vessel; and wherein aid pressure relief preventing means comprises an automatic isolation valve in each of said slurry conduit and said return line, a pressure sensor connected to said slurry conduit for sensing the pressure therein, and a controller connected to said isolation valves and operating said isolation valves in response to the pressure sensed by said pressure sensor.

12. A system as recited in claim 11 wherein said one or more pumps comprises first and second high pressure slurry pumps connected in series and each having pressure rating, an inlet and an outlet, said first pump inlet operatively connected to said steaming vessel, and said first pump outlet operatively connected to said second pump inlet, said second pump having a higher pressure rating than said first pump; and wherein said treatment vessel comprises a continuous digester.

13. A system as recited in claim 12 further comprising means for augmenting the flow of liquid to said inlet or an outlet from to said second slurry pump.

14. A system as recited in claim 13 wherein said means for augmenting the flow of liquid comprises a liquid line having liquid at a pressure below the pressure at said second slurry pump inlet, a conduit between said liquid line and said inlet, and a liquid pump in said conduit.

15. A system as recited in claim 14 wherein said liquid line is said return line and said conduit is connected directly to said return line.

16. A system as recited in claim 14 wherein said liquid return line is connected to a flash tank having a liquid outlet, and wherein said conduit is connected to said flash tank liquid outlet.

17. A system as recited in claim 16 wherein said flash tank has a steam outlet, and wherein said steam outlet is connected to said steaming vessel.

18. A method of feeding wood chips to the top of a treatment vessel comprising the steps of:

(a) steaming the wood chips to remove air therefrom and to heat the material;

(b) slurrying the wood chips with a cooking liquor to produce a slurry of liquid and material; and (c) pressurizing the slurry to a pressure of at least about 5 bar gauge at a location at least thirty feet below the top of the treatment vessel and transferring pressurized wood chips to the top of the treatment vessel, said pressurizing step consisting of acting on the slurry with one or more high pressure slurry pumps.

19. A method as recited in claim 18 comprising the further steps of: (d) returning liquid separated from the slurry at the top of the treatment vessel to the at least one pump; and (e) sensing the pressure of the slurry while being transferred to the top of the treatment vessel, and shutting off the flow of slurry to the top of the treatment vessel and the return of liquid from the top of the vessel if the sensed pressure drops below a predetermined value.

20. A method as recited in claim 18 comprising the further steps of: (d) returning liquid separated from the slurry at the top of the treatment vessel to the at least one pump; and (e) flashing the liquid while returning in the practice of step (d) to produce steam, and using the steam in the practice of step (a).

* * * * *

US005753075C1

(12) EX PARTE REEXAMINATION CERTIFICATE (9940th)

United States Patent
Stromberg et al.

(10) Number: US 5,753,075 C1
(45) Certificate Issued: Nov. 15, 2013

(54) METHOD AND SYSTEM FOR FEEDING COMMINUTED FIBROUS MATERIAL

(75) Inventors: C. Bertil Stromberg, Glens Falls, NY (US); J. Wayne Chamblee, Queensbury, NY (US); Bruno S. Marcoccia, Queensbury, NY (US); Rolf C. Ryham, Suwanee, GA (US); Erwin D. Funk, Queensbury, NY (US)

(73) Assignee: Andritz Inc., Glen Falls, NY (US)

Reexamination Request:
No. 90/010,403, Feb. 6, 2009

Reexamination Certificate for:

| | |
|---|---|
| Patent No.: | **5,753,075** |
| Issued: | **May 19, 1998** |
| Appl. No.: | **08/738,239** |
| Filed: | **Oct. 25, 1996** |

(51) Int. Cl.

| | |
|---|---|
| ***D21C 1/00*** | (2006.01) |
| ***D21C 1/10*** | (2006.01) |
| ***D21C 7/06*** | (2006.01) |
| ***D21C 7/00*** | (2006.01) |

(52) U.S. Cl.
CPC ... *D21C 1/10* (2013.01); *D21C 7/06* (2013.01)
USPC ..... 162/52; 162/237; 162/246; 162/56

(58) Field of Classification Search
None
See application file for complete search history.

(56) References Cited

To view the complete listing of prior art documents cited during the proceeding for Reexamination Control Number 90/010,403, please refer to the USPTO's public Patent Application Information Retrieval (PAIR) system under the Display References tab.

*Primary Examiner* — Krisanne Jastrzab

(57) ABSTRACT

A system and method for feeding comminuted cellulosic fibrous material such as wood chips to the top of a treatment vessel such as a continuous digester provide enhanced simplicity, operability, and maintainability by eliminating the high pressure transfer device conventionally used in the prior art. Instead of a high pressure transfer device the steamed and slurried chips are pressurized using one or more slurry pumps located at least thirty feet below the top of the treatment vessel and for pressurizing the slurry to a pressure of at least about 10 bar gauge. A return line from the top of the digester may, but need not necessarily, be operatively connected to the one or more pumps and if connected to the pumps the pressure in the return line may be reduced utilizing a pressure reduction valve and/or a flash tank. Steam from the flash tank may be used in steaming the chips. Pressure relief prevention may be provided by isolation valves in the lines leading to and from the top of the treatment vessel controlled by a controller which is responsive to the pressure sensed in the slurry line leading to the top of the treatment vessel.

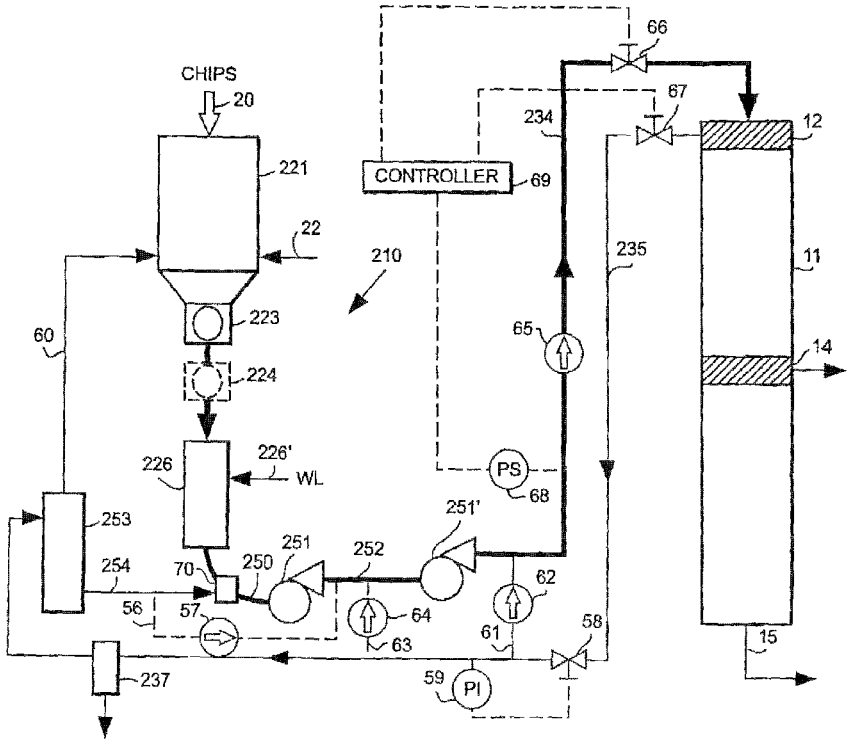

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 18 is confirmed.

Claims 1-3 are cancelled.

Claims 4-17 and 19-20 were not reexamined.

* * * * *

US005753075C2

(12) EX PARTE REEXAMINATION CERTIFICATE (10552nd)

United States Patent
Stromberg et al.

(10) Number: US 5,753,075 C2
(45) Certificate Issued: Mar. 27, 2015

(54) METHOD AND SYSTEM FOR FEEDING COMMINUTED FIBROUS MATERIAL

(75) Inventors: C. Bertil Stromberg, Glens Falls, NY (US); J. Wayne Chamblee, Queensbury, NY (US); Bruno S. Marcoccia, Queensbury, NY (US); Rolf C. Ryham, Suwanee, GA (US); Erwin D. Funk, Queensbury, NY (US)

(73) Assignee: Andritz Inc., Glen Falls, NY (US)

Reexamination Request:
No. 90/013,176, Apr. 15, 2014

Reexamination Certificate for:

| | |
|---|---|
| Patent No.: | **5,753,075** |
| Issued: | **May 19, 1998** |
| Appl. No.: | **08/738,239** |
| Filed: | **Oct. 25, 1996** |

Reexamination Certificate C1 5,753,075 issued Nov. 15, 2013

(51) Int. Cl.

| | |
|---|---|
| ***D21C 1/00*** | (2006.01) |
| ***D21C 1/10*** | (2006.01) |
| ***D21C 7/06*** | (2006.01) |
| ***D21C 7/00*** | (2006.01) |

(52) U.S. Cl.
CPC ... *D21C 7/06* (2013.01); *D21C 1/10* (2013.01)
USPC ..... 162/52; 162/237; 162/246; 162/56

(58) Field of Classification Search
None
See application file for complete search history.

(56) References Cited

To view the complete listing of prior art documents cited during the proceeding for Reexamination Control Number 90/013,176, please refer to the USPTO's public Patent Application Information Retrieval (PAIR) system under the Display References tab.

*Primary Examiner* — Terrence Till

(57) ABSTRACT

A system and method for feeding comminuted cellulosic fibrous material such as wood chips to the top of a treatment vessel such as a continuous digester provide enhanced simplicity, operability, and maintainability by eliminating the high pressure transfer device conventionally used in the prior art. Instead of a high pressure transfer device the steamed and slurried chips are pressurized using one or more slurry pumps located at least thirty feet below the top of the treatment vessel and for pressurizing the slurry to a pressure of at least about 10 bar gauge. A return line from the top of the digester may, but need not necessarily, be operatively connected to the one or more pumps and if connected to the pumps the pressure in the return line may be reduced utilizing a pressure reduction valve and/or a flash tank. Steam from the flash tank may be used in steaming the chips. Pressure relief prevention may be provided by isolation valves in the lines leading to and from the top of the treatment vessel controlled by a controller which is responsive to the pressure sensed in the slurry line leading to the top of the treatment vessel.

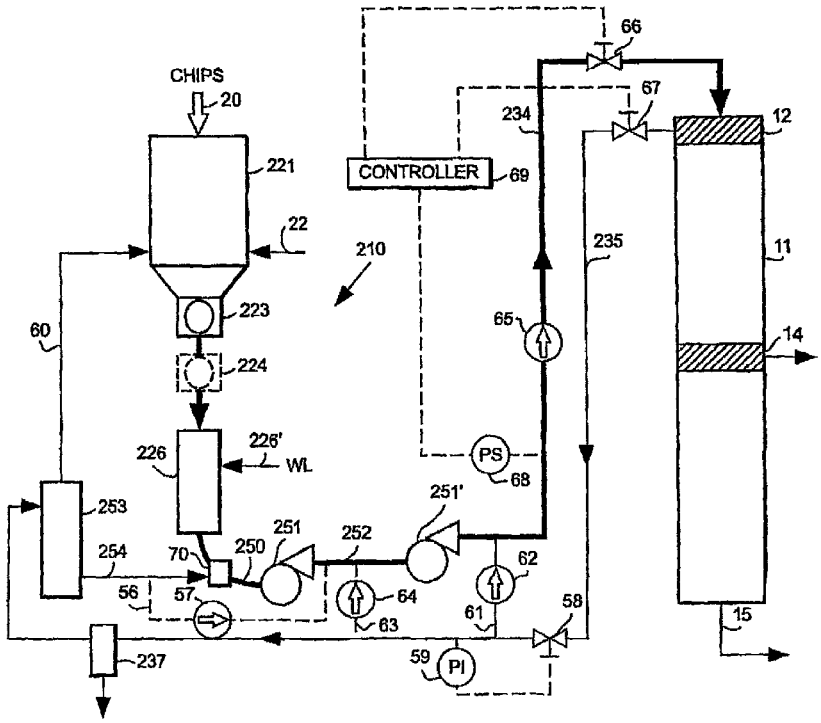

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3 were previously cancelled.

Claim 18 is determined to be patentable as amended.

New claims 21-26 are added and determined to be patentable.

Claims 4-17, 19 and 20 were not reexamined.

18. A method of feeding wood chips to the top of a treatment vessel *in a continuous feed process* comprising the steps of:

(a) steaming the wood chips to remove air therefrom and to heat the material;

(b) slurrying the wood chips with a cooking liquor to produce a slurry of liquid and material*, and the slurry has a liquid-to-solids ratio of between 2 and 10*; and (c) pressurizing the slurry to a pressure of at least [about] 5 bar gauge at a location at least thirty feet below the top of the treatment vessel and transferring pressurized wood chips to the top of the treatment vessel, said pressurizing step consisting of acting on the slurry with one or more high pressure slurry pumps*, at least one of the pumps is a helical screw-type pump*.

*21. The method as recited in claim 18 wherein the slurry has a liquid-to-solids ratio of 3 to 7.*

*22. The method as recited in claim 18 wherein the slurry has a liquid-to-solids ratio of 3 to 6.*

*23. A method of feeding wood chips to the top of a treatment vessel in a continuous feed process comprising the steps of:*

*(a) steaming the wood chips in a chip bin or steaming vessel to remove air therefrom and to heat the wood chips;*

*(b) slurrying the wood chips with a cooking liquor to produce a slurry of the cooking liquor and the wood chips;*

*(c) setting a flow of at least one of the wood chips and the cooking liquor to cause the slurry to have a liquid-to-solids ratio, on a volume basis, of 2 to 10; and*

*(d) transferring pressurized slurry of the wood chips and the cooking liquor to the top of the treatment vessel, said pressurizing step consisting of acting on the slurry with one or more high pressure slurry pumps that increases the pressure of the slurry such that the pressure is at least 5 bar gauge at the top of the treatment vessel, at least one of the slurry pumps is a helical screw-type pump.*

*24. The method of claim 23 wherein the treatment vessel is one of an impregnation vessel and a digester vessel.*

*25. The method as recited in claim 23 wherein the slurry has a liquid-to-solids ratio of 3 to 7.*

*26. The method as recited in claim 23 wherein the slurry has a liquid-to-solids ratio of 3 to 6.*

* * * * *